US008240343B2

(12) United States Patent
Dyer et al.

(10) Patent No.: US 8,240,343 B2
(45) Date of Patent: Aug. 14, 2012

(54) JAW ASSEMBLY FOR CABLE TIE TOOL

(75) Inventors: Edward P. Dyer, Germantown, WI (US); Donald V. Lyskawa, Grafton, WI (US)

(73) Assignee: Hellermanntyton Corporation, Milwaukee, WI (US)

( * ) Notice: Subject to any disclaimer, the term of this patent is extended or adjusted under 35 U.S.C. 154(b) by 902 days.

(21) Appl. No.: 12/298,497

(22) PCT Filed: Apr. 26, 2006

(86) PCT No.: PCT/US2006/015777

§ 371 (c)(1), (2), (4) Date: Oct. 24, 2008

(87) PCT Pub. No.: WO2007/123547

PCT Pub. Date: Nov. 1, 2007

(65) Prior Publication Data

US 2009/0178724 A1 Jul. 16, 2009

(51) Int. Cl.
*B21F 9/02* (2006.01)

(52) U.S. Cl. ..... 140/93.2

(58) Field of Classification Search ..... 140/93 R, 140/93.2, 93.4, 123.5, 93 A; 100/25, 26, 100/30; 53/589

See application file for complete search history.

(56) References Cited

U.S. PATENT DOCUMENTS

| | | | | |
|---|---|---|---|---|
| 4,004,618 | A | 1/1977 | Turek | |
| 5,429,158 | A * | 7/1995 | Kurmis | 140/93.2 |
| 5,845,681 | A | 12/1998 | Kurmis | |
| 5,915,424 | A * | 6/1999 | Franks et al. | 140/92.1 |
| 6,019,142 | A | 2/2000 | Kurmis | |
| 6,655,417 | B2 | 12/2003 | Kurmis | |
| 6,758,247 | B2 | 7/2004 | Thieme | |
| 7,334,610 | B2 * | 2/2008 | Levin et al. | 140/93.2 |

* cited by examiner

*Primary Examiner* — Edward Tolan

(74) *Attorney, Agent, or Firm* — Joseph S. Heino; Patrick M. Bergin

(57) ABSTRACT

A jaw assembly for use with a tool for bundling elongated items with a tie strap, the strap having a tail and a tail-receiving head, the tool having a tool body, means for actuating the jaw assembly from an open position to a closed position, and means for introducing the tail of the strap to the jaw assembly, the jaws of the jaw assembly being mounted in a movable manner on the tool body, each jaw providing a guide means for the tie tail, and at least one jaw including means for receiving a tie mount within the jaw, the tie mount including means for receiving a portion of the tie strap tail through it such that a tie tail introduced to the jaw assembly is guided along each jaw and through the tail receiving means of the tie mount to bundle the elongate items.

18 Claims, 8 Drawing Sheets

JAW ASSEMBLY FOR CABLE TIE TOOL

FIELD OF THE INVENTION

This invention relates generally to tools and devices used to bundle together elongated items such as wires, cables, hoses, and the like, by means of a tie strap, the tie strap having a tail and a tail-receiving head, and to also attach the bundle to a surface. More specifically, it relates to a tool having a tool body and a jaw assembly, the jaw assembly including a pair of jaws that are cooperatively mounted in a movable manner on the tool body and forming a tie-path continuum along the jaw members. It also relates more specifically to a jaw assembly wherein at least one of the jaw members includes a receiver such that, when a tie mount is placed within the receiver, a portion of the tie mount also forms part of the tie-path continuum.

BACKGROUND OF THE INVENTION

A tool of this general type is described and claimed in U.S. Pat. No. 6,655,417 issued to Kurmis (the "Kurmis tool"), the disclosure of which is incorporated herein by reference. The Kurmis tool has a tool body, on one end of which are cooperating jaws, the jaws being movable from an "open" position to a "closed" position. In their closed position, the jaws effectively form a "wrap-around" clamp. This wrap-around clamp is configured to be closed around a bundle of elongated items that are to be bound. In this closed position, the wrap-around clamp also forms a near-continuous guide for a tie strap that is used to encircle the elongated items to be bound by the tool. For this purpose, the jaws have, on their inwardly-directed edge, a guide groove which is connected to a tie strap guide located within the tool. The guide groove is configured to provide a pathway continuum for receiving the tail of the tie strap, the tie strap being air-ejectable, tail first, from a receiver within the tool.

The guide groove of the Kurmis tool is continuous if the tie strap is not used with a tie. The guide groove, however, is not continuous at the location at which, in the closed state, the jaws approach one another at their respective free ends when the tie strap is to be used with a tie. This is because the jaws each have a "cutout" at their free or distal ends. The cutouts of the Kurmis tool serve to form a free space in the closed state of the jaws for receiving a fastening element, such as a tie mount, a band eyelet or similar structure, by means of which the tie strap which is to be bound is fastened onto the carrying structure. The tie mount is configured to fit into the free space formed by the cutouts and supplements that region of the tie strap guide in the clamp which is missing. Overall, this effectively provides a continuous guide for the tie strap, but only when the clamps are in their closed state and then only when the clamps are engaged with the tie mount.

In the view of these inventors, there is a need to provide a tool of the type mentioned above but which avoids, or at least reduces, the disadvantage of having to position and place a tie mount between the jaw ends prior to application of the tie strap to the tie mount. What is also needed is a jaw configuration that ensures proper orientation of the tie mount relative to the tie strap and to the tie strap guide continuum such that the tie mount can be attached to the tie strap as the strap is drawn around and secured to the elongated items to be bundled.

SUMMARY OF THE INVENTION

It is, therefore, a principal object of this invention to provide a new and useful jaw assembly for use with a tool of the type for binding elongated items by means of a tie strap, the tool having a tool body and a clamp formed by opposing jaws. It is another object of the present invention to provide a jaw assembly that is mounted in a movable manner on the tool body, and is provided with a tie strap guide. It is still another object of this invention to provide such a jaw assembly where it is possible for the jaws to be closed such that, in a closed state of the clamp, their distal ends are engaged about the elongated items to be bound. It is yet another object of the present invention to provide a tie mount receiver within at least one of the jaws, a portion of the tie mount also forming part of the tie strap guide continuum. It is still another object of this invention to provide such a tie mount receiver within at least one of the jaws, the receiver being configured to allow for side-loading of a tie mount within the mount receiver.

The jaw assembly of the present invention has obtained these objects. It provides for a jaw assembly for use with a tool for bundling elongated items together by means of a tie strap. The tie strap is of the type having a tail and a tail-receiving head. The jaw assembly is used as part of a tool having a tool body, means for actuating the jaw assembly from an open position to a closed position, and means for introducing the tail of the tie strap to the jaw assembly. The jaw assembly includes a pair of cooperating jaws, the jaws being mounted in a movable manner on the tool body, and each jaw providing a guide means for the tie tail and at least one jaw including means for receiving a tie mount within the jaw, and the tie mount including means for receiving a portion of the tie strap tail through it. In this fashion, a tie strap tail that is introduced to the jaw assembly is guided along each jaw and through the tail receiving means of the tie mount to bundle the elongated items together and to allow the items to be secured to a surface by use of the tie mount. An alternative embodiment of the jaw assembly of the present invention includes a tie mount receiver that is configured to allow for side-loading of a tie mount within the tie mount receiver.

The foregoing and other features of the jaw assembly of the present invention will be apparent from the detailed description that follows.

DETAILED DESCRIPTION OF THE PREFERRED EMBODIMENT

Figure 1A:
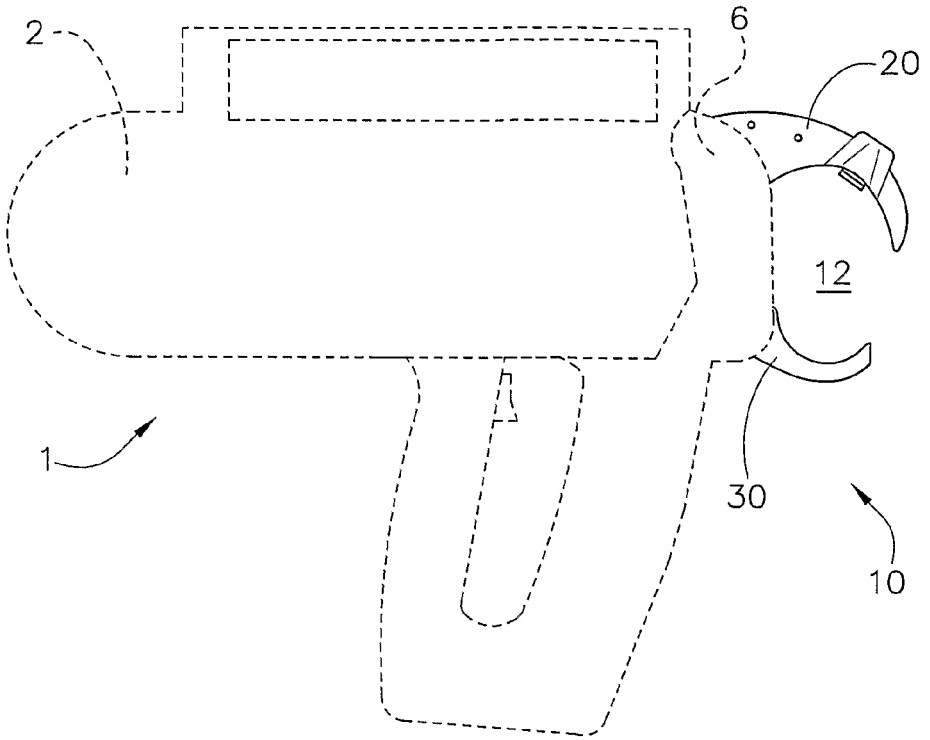
FIG. 1A is a left side elevational view of a cable tie tool, shown in phantom view, that utilizes the jaw assembly of the present invention and showing the jaws in the "opened" position and also showing a tie mount receiver configured within the upper jaw member of the jaw assembly.
Figure 1B:
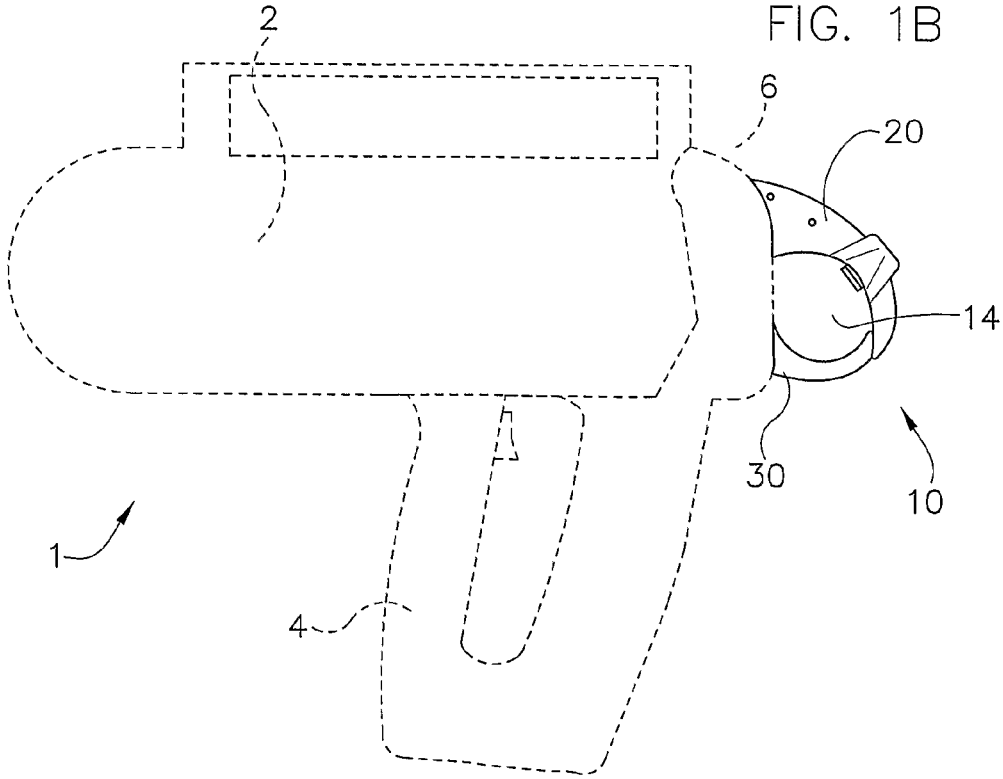
FIG. 1B is the same view of the cable tie tool as is illustrated in FIG. 1A but showing the jaws in the "closed" position.

Referring now to the drawings in detail, wherein like numerals represent like structure and elements throughout, FIGS. 1A and 1B illustrate a preferred embodiment of a jaw assembly, generally identified 10, constructed and used with a cable tie tool in accordance with the present invention. The tool itself is shown in phantom view and is generally identified 1. The tool 1 has a tool body 2 with a handle 4, arranged in a gun-like manner, with the jaw assembly 10 disposed at its front end 6. As is known, the tool 1 contains a drive means (not shown) that is electrically or pneumatically actuated and a control device (also not shown) for different tool functions, in particular the movement of the jaw assembly 10 from an "open" position to a "closed" position, and the tensioning of a tie strap therewithin.

Figure 2:
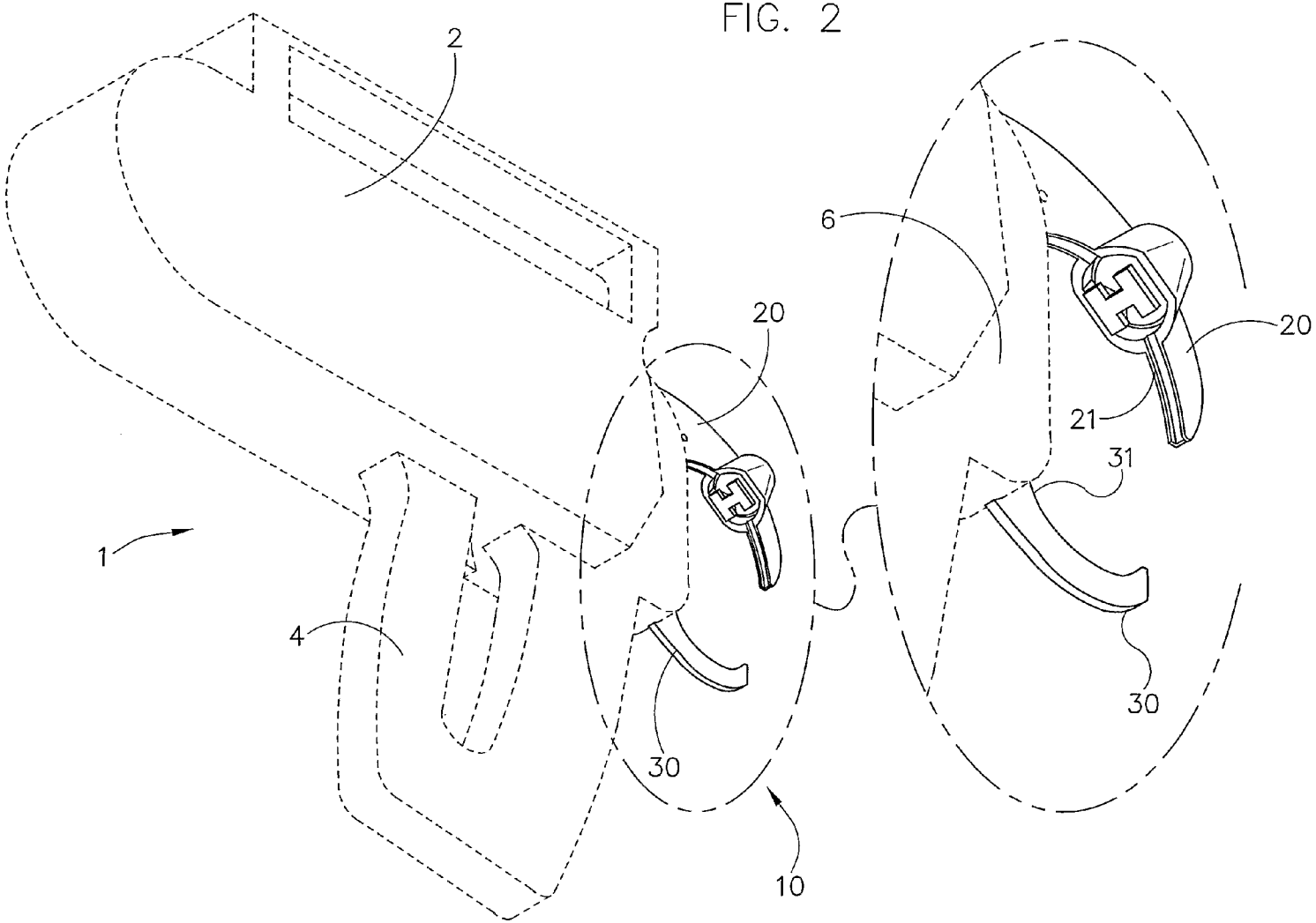
FIG. 2 is an enlarged rear, bottom and left side perspective view of a cable tie tool and, in particular, the jaw assembly thereof.
Figure 4:
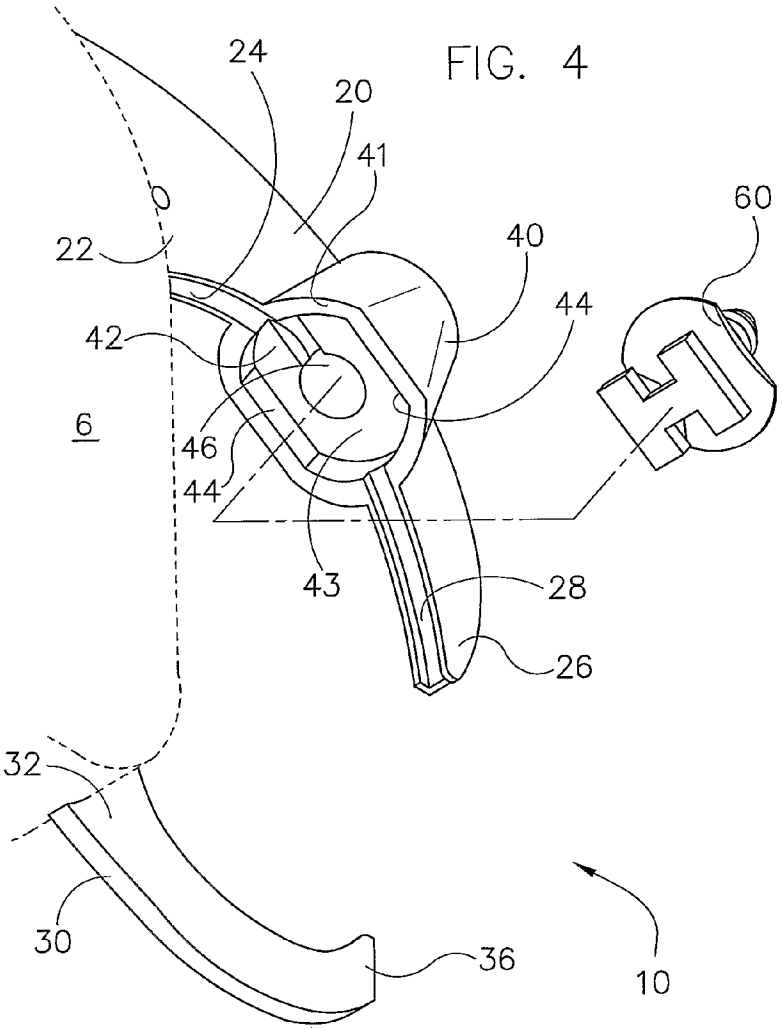
FIG. 4 is a further enlarged bottom, rear and left side perspective view of the jaw assembly illustrated in FIG. 2, showing the tie mount of the type that would be retained within the receiver of the upper jaw member.
Figure 3:
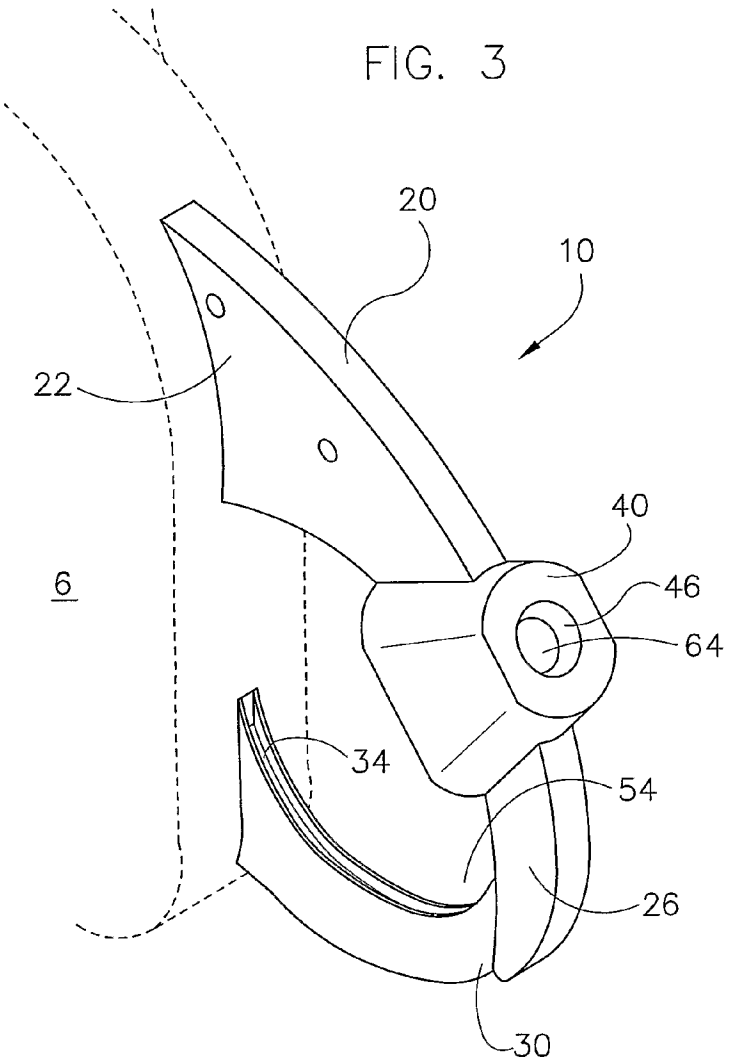
FIG. 3 is a further enlarged top, front and left side perspective view of the jaw assembly illustrated in FIG. 2, showing the jaws in the "closed" position.
Figure 6:
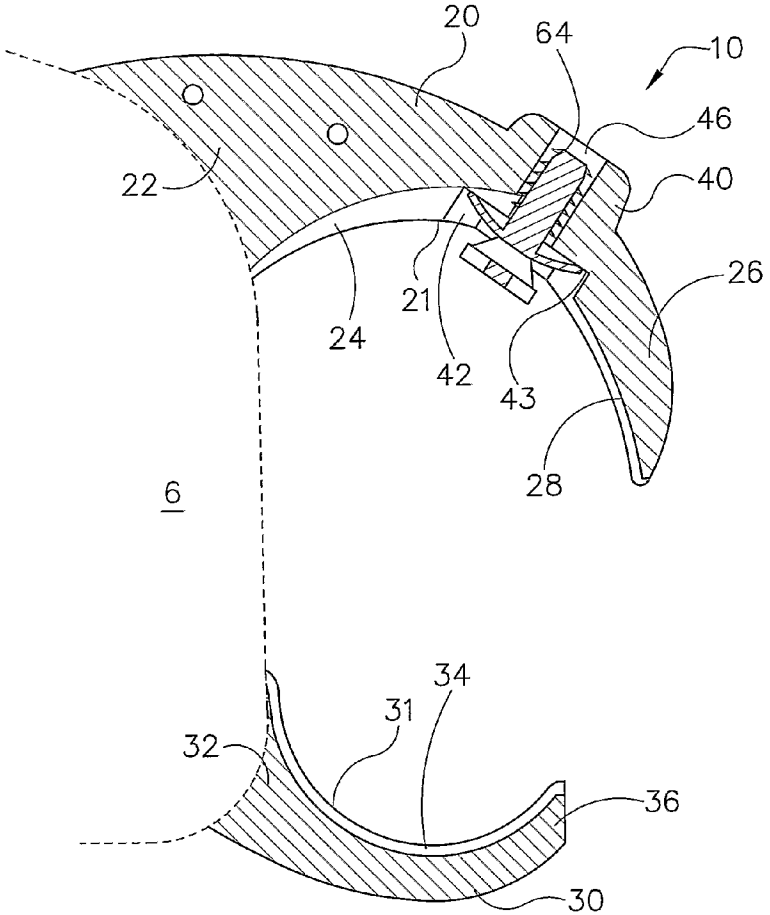
FIG. 6 is a cross-sectioned left side elevational view of the jaw assembly illustrated in FIGS. 1A, 1B and FIGS. 3-5.
Figure 5:
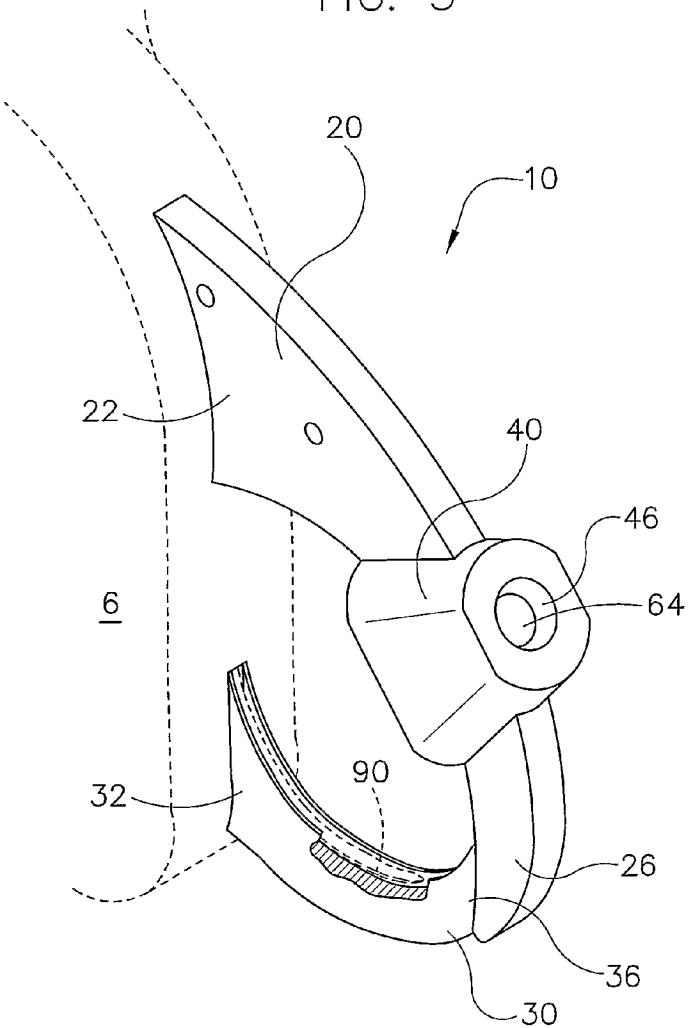
FIG. 5 is a view of the jaw assembly similar to that illustrated in FIG. 3 but showing a partial cut-away view of the lower jaw member and the path of a strap, shown in phantom view, as it would pass along the lower jaw member.

The jaw assembly 10 of the present invention is formed generally by two jaws 20, 30 that are arranged on the front end 6 of the tool body 1. See also, FIG. 2 and insert. For reference purposes only, the jaws 20, 30 will be referred to as the upper jaw 20 and the lower jaw 30. The jaws 20, 30 are mounted in a movable manner on the tool body 2 as described above. As is more clearly seen in FIGS. 4 through 6, the upper jaw 20 is a generally outwardly and downwardly-extending arcuate structure that includes a portion 22 that is proximal to the tool body 2 and a portion 26 that is distal to it. Additionally, the upper jaw 20 includes a downwardly and inwardly facing jaw edge 21. See FIG. 2 insert. Similarly, the lower jaw 30 is a generally outwardly and upwardly-extending arcuate structure that includes a portion 32 that is proximal to the tool body 2 and a portion 36 that is distal to it. See FIG. 4. The lower jaw 30 also includes an upwardly and inwardly facing jaw edge 31 that opposes the edge 21 of the upper jaw 20. See FIG. 2 insert. When the jaws 20, 30 are in their "open" position as shown in FIG. 1A, the jaws 20 form an opening 12 within which a bundle of elongated items may be located. On the other hand, when the jaws 20, 30 are in their "closed" position as shown in FIG. 1B, the jaws 20, 30 form a smaller, and generally circular, opening 14 within which the bundle of elongated items may be contained.

It is to be understood that, within the tool body 2, a tie strap tail guide (not illustrated) is contained which is adjoined by a further tie strap tail guide that is configured within the arcuate jaws 20, 30 to form a tie strap guide continuum. In operation, electrically-actuated mechanical reciprocation and traction, for example, can be used to eject a tie strap 90, shown in phantom view in FIG. 5, tail-end first, from within the tool body 2 and outwardly of the tool body 2 along the jaws 20, 30. This presentation of the tie strap 90 is known in the art. More specifically as it relates to the present invention, the inner guide of the tool 1 is substantially continuous and curvilinear with a guide groove 34 that is defined within the upper and inward-facing edge 31 of the arcuate lower jaw 30 and is also substantially continuous and curvilinear with guide grooves 24, 28 that are defined within the downward and inward-facing edge 21 of the arcuate upper jaw 20. See FIG. 6. In proper sequence, a tie strap 90 that passes out of the end 6 of the tool body 2, tail-end first, is guided along the guide groove 34 of the proximal and distal portions 32, 36, respectively, of the lower jaw 30, then along the guide groove 28 of the distal portion 26 of the upper jaw 20, and finally along the guide groove 24 of the proximal portion 22 of the upper jaw 20. In that sequence, the tie strap tail encircles the elongated items that are to be bound, and then routes the tail back to the tool body 1 for the binding to be completed there where the tail is inserted through a head and then tensioned.

Figure 1C:
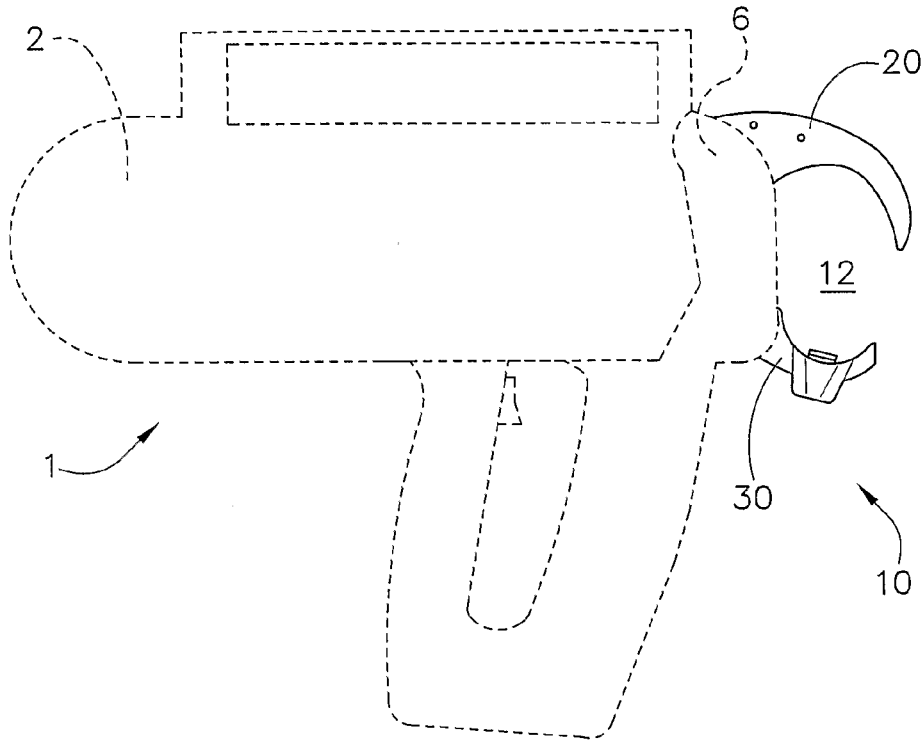
FIG. 1C is a view similar to that shown in FIG. 1A but illustrating the tie mount receiver alternatively configured within the bottom jaw member of the jaw assembly.
Figure 1D:
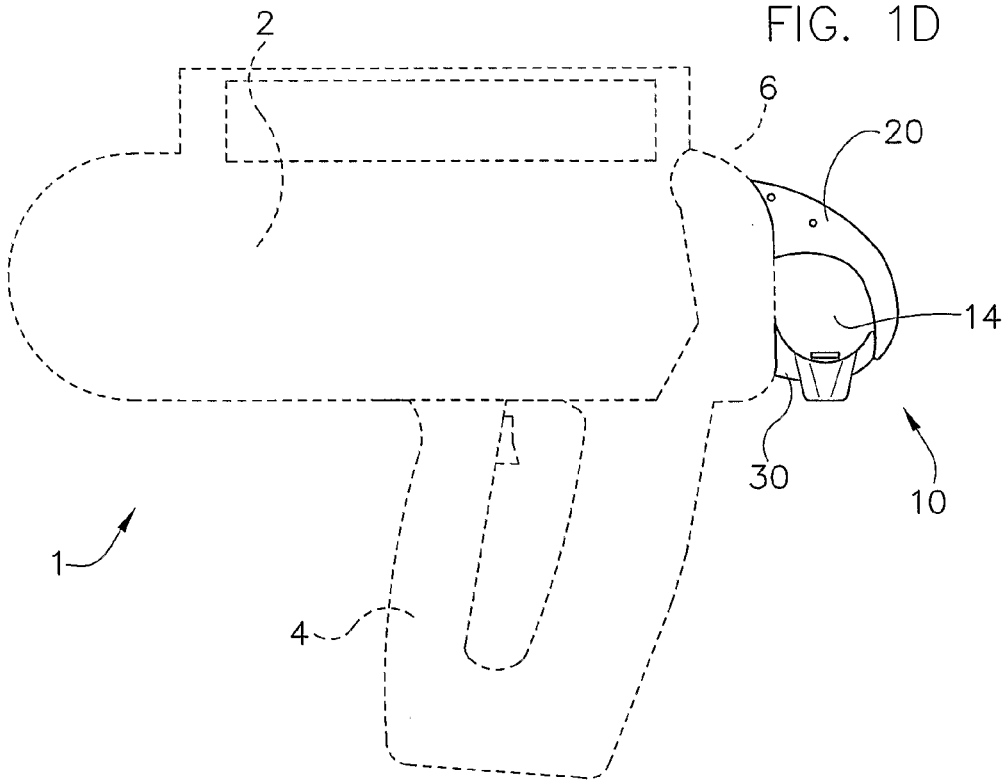
FIG. 1D is the same view of the alternative embodiment of cable tie tool and jaw assembly as is illustrated in FIG. 1C but showing the jaws in the "closed" position.

In the preferred embodiment of the present invention, an upper jaw receiver 40 is disposed between the guide groove 28 of the distal portion 26 of the upper jaw 20 and the guide groove 24 of the proximal portion 22 of the upper jaw 20. The upper jaw receiver 40 is configured with an inwardly facing first aperture 42, this first aperture 42 including a rim 41 that substantially surrounds a transversely-disposed shoulder 43. A portion of the rim 41 of the first aperture 42 is also discontinuous about the receiver 40 due to the guide grooves 24, 28 that are defined within the upper jaw 20. The upper jaw receiver 40 also includes a second aperture 46 that extends outwardly from the shoulder 43 of the first aperture 42. In the preferred embodiment, the first aperture 42 is also a generally cylindrically-shaped structure having opposed flats 44 defined within it. The purpose of this structure is to provide an alignment means for a tie mount 60 that is placed within the upper jaw receiver 40. See FIG. 4. In an alternative embodiment, the lower jaw 30 would be configured with a lower jaw receiver as is shown in FIGS. 1C and 1D, the structure and functionality being essentially the same as that described above and below for the upper jaw 20 and the upper jaw receiver 40.

Figure 7A:
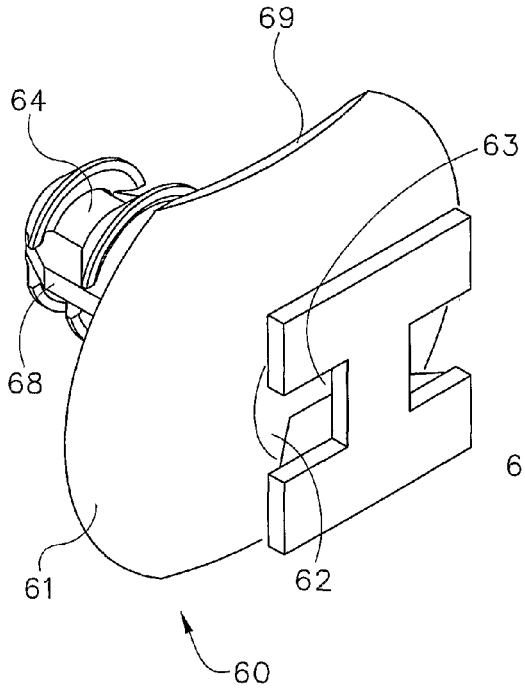
FIGS. 7A and 7B are enlarged top and bottom perspective views of the tie mount illustrated in FIGS. 4 and 6.
Figure 7B:
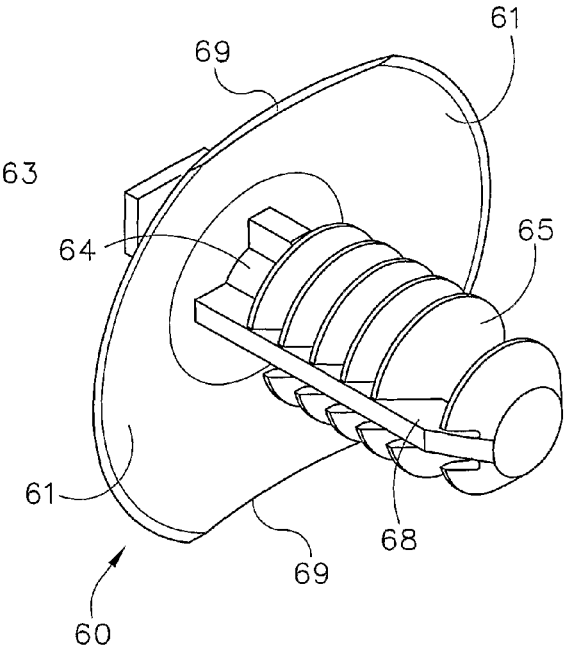
Figure 7C:
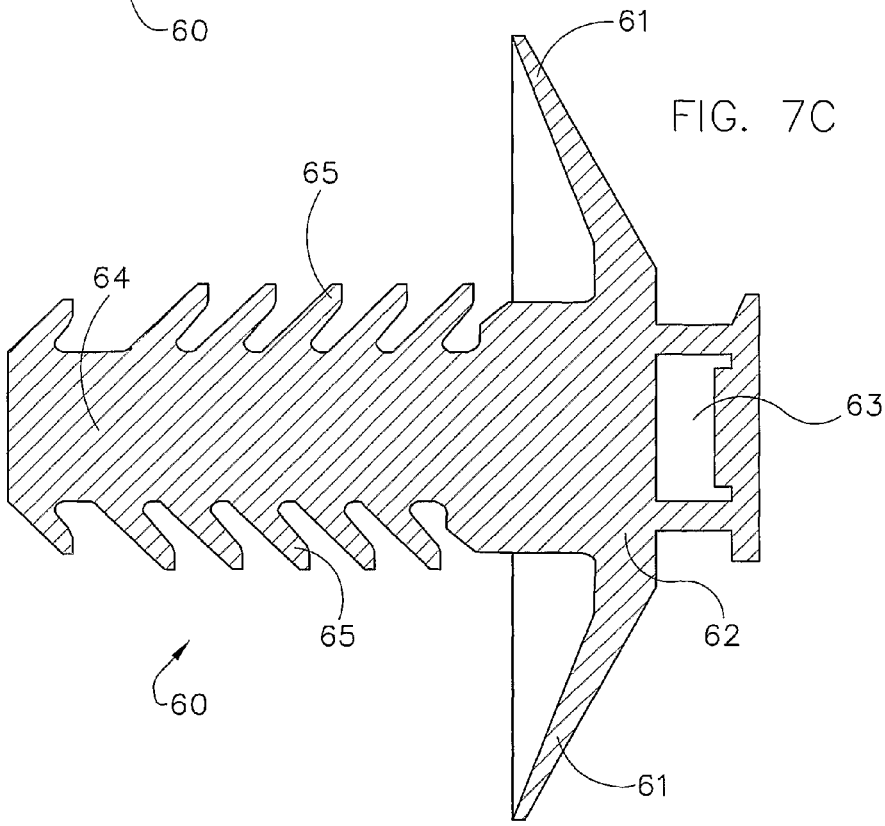
FIG. 7C is a further enlarged and cross-sectioned elevational view of the tie mount illustrated in FIGS. 7A and 7B.

In the preferred embodiment of the present invention, the jaw receiver 40 is functionally adapted to receive a tie mount 60 of the type illustrated in FIGS. 7A through 7C. A tie mount 60 of this type is preferably a "fir-tree" type tie mount. The precise shape of the tie mount 60 is not, however, a limitation of the present invention. As shown, the tie mount 60 has the essential elements of a head portion 62 and a trunk portion 64. It is to be understood, however, that other constructions could be used which could be adapted for use within the jaw assembly 10 of the present invention. Alternatively, the jaw receiver 40 could be adapted for use with tie mounts of other constructions and still come within the scope of the claims herein.

The head portion 62 of the tie mount 60 shown in the preferred embodiment includes a slot opening 63 defined within it. The slot opening 63 is configured to receive and retain a portion of the tie strap 90 within it. Disposed below the head 62 is a circumferential diaphragm or umbrella portion 61. Disposed below the umbrella portion 61 is the trunk 64 of the tie mount 60 which has a plurality of transversely disposed and outwardly-extending lamella or "branches" 65 about it. As shown, the branches 65 are biased upwardly of the trunk 64 towards the head 62 so as to lessen the amount of force necessary for insertion of the tie mount 60 into an aperture (not shown) defined in a surface (also not shown) that the tie mount 60 may be attached to, and to increase the amount of resistance to be overcome in extracting the mount 60 from that surface. In the preferred embodiment, the branches 65 are not continuous about the trunk 64 of the tie mount 60, but are interrupted by a pair of opposing separation ribs 68 that are defined within the trunk 64 and are axially aligned with it. It should also be noted that the branches 65 to either side of the trunk 64 are staggered from one side as compared to the other. See FIG. 7C. This feature adds further stability to the tie mount 60 following insertion of the trunk 64 into the receiving aperture. As shown in FIGS. 7A and 7B, it will be seen that the tie mount umbrella portion 61 includes opposing flats 69, such flats 69 being functionally adapted to align with and abut the flats 44 that are disposed within the aperture 42 of the receiver 40 of the upper jaw 20, as described above.

In application, the user places a tie mount 60 within the tie mount receiver 40 of the jaw 20, the jaws 20, 30 being in the "open" position and the user being careful to seat the tie mount 60 such that the flats 69 are aligned with the flats 44 of the jaw aperture 42 of the receiver 40. As this occurs, the trunk 64 and branches 65 of the tie mount 60 are urged into the second aperture 46 of the receiver 40 to the point that the umbrella portion 61 of the tie mounts 60 "seats" with the shoulder 43 of the first aperture 42 of the receiver 40. In this position, the slot opening 63 of the tie mount head 62 is properly positioned relative to the jaw guide grooves 24, 28 of the upper jaw 20. The branches 65 about the trunk 64 cause a gentle friction fit of the tie mount 60 within the receiver 40 to prevent the tie mount 60 from dislodging during positioning of the tool 1 relative to the bundle of elongated items 80 that are to be bound. This mount 60 insertion step may also be facilitated by use of a pre-loaded clip (not shown) along which a plurality of mounts 60 may be removably attached to allow the user to quickly insert the mounts 60 in relatively rapid sequence and without the need for the user to handle each mount 60 separately.

Figure 8:
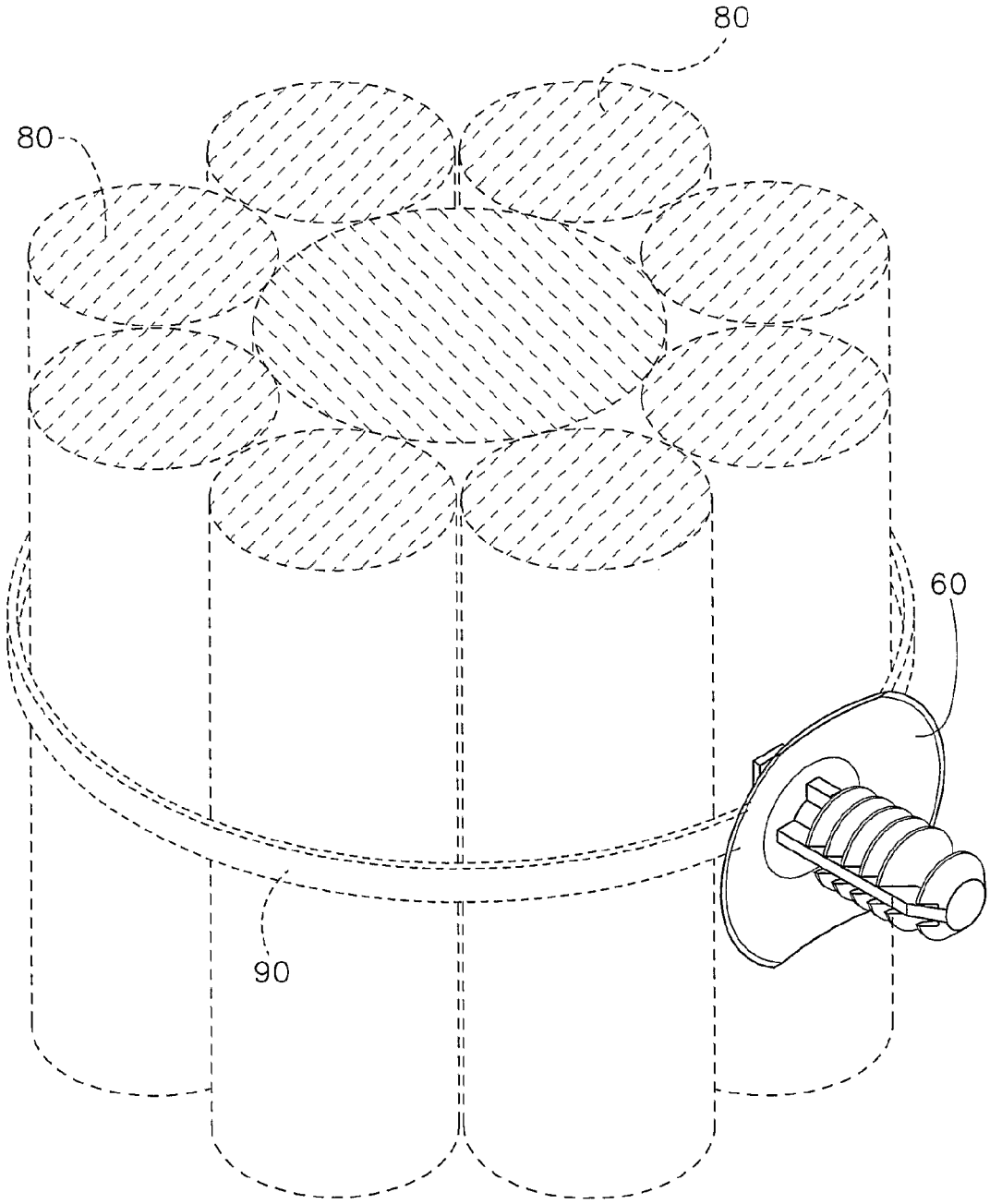
FIG. 8 is a perspective view of a tie mount with a strap, shown in phantom view, attached to a bundle of elongated items, also shown in phantom view.

Next, the tool 1 is positioned such that the jaws 20, 30 envelop the bundle of elongated items 80 to which a tie strap 90 and tie mount 60 will be applied. See FIG. 8. The tool 1 is then actuated such that the jaws 20, 30 encircle and clamp down upon the bundle of objects 80. The tool 1 is next actuated to eject a tie strap 90, tail first, out of the tool body 2 which is then guided along the guide groove 34 of the lower jaw 30, then along the guide groove 28 of the distal portion 26 of the upper jaw 20, through the slot opening 63 of the mount 60, and finally along the guide groove 24 of the proximal portion 22 of the upper jaw 20. In that sequence, the tie strap tail 90 encircles the bundle of objects 80 which is to be bound, and then routes the tail back to the tool body 1 for the binding to be completed there where the tail 90 is inserted through a head and then tensioned. The jaws 20, 30 are then opened and removed from the bundle of elongated items 80. The bundle of elongated items 80, with the tie mount 60 and the tie strap 90 attached, is then ready to be secured to a surface by means the aperture (not shown) that is dimensioned to receive the tie trunk 64 within it. See FIG. 8.

It should also be mentioned that the jaw assembly 10 of the present invention could be used for bundling elongated items without using a tie mount 60. In the preferred embodiment, the groove 24 at the proximal portion 22 of the upper jaw 20 is, at its point closest to the first receiver aperture 42, formed significantly deeper into the upper jaw 20 to ensure that the tail of a strap 90 passing from the groove 28 at the distal portion 26 of the upper jaw 20 does not snag or get caught on the sidewall of the second receiver aperture 46. See FIG. 6.

Figure 9B:
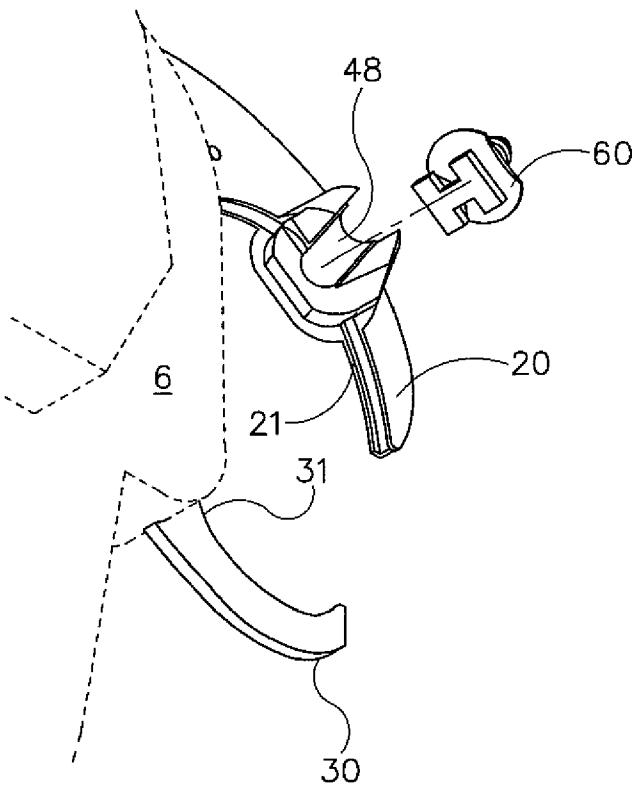
FIGS. 9A and 9B are rear, bottom and left side perspective views of the cable tie tool and, in particular, the jaw assembly thereof wherein the upper jaw member is configured for side-loading of a tie mount within it.
Figure 9A:
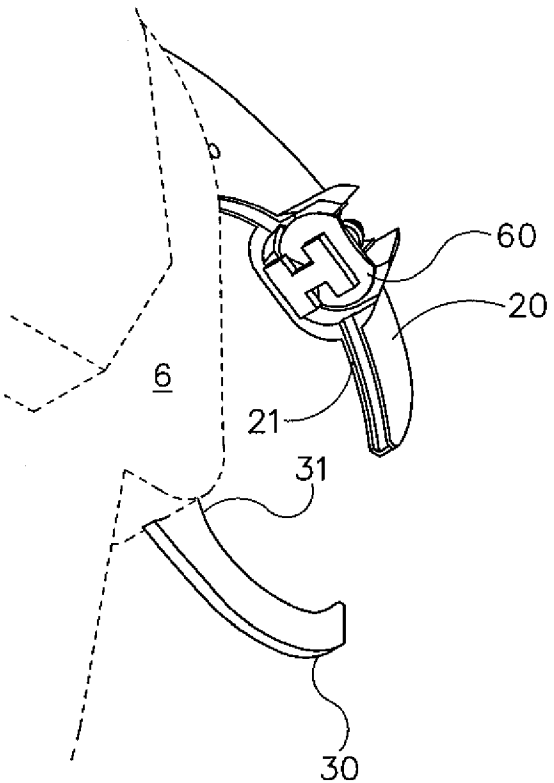

An alternative embodiment of the upper jaw 20 is illustrated in FIGS. 9A and 9B. As shown, the upper jaw 20 is configured with a side-load aperture 48. The side-load aperture 48 is functionally adapted to receive a tie mount 60 of the type described above within it. Specifically, FIG. 9A shows the tie mount 60 as retained within the side-load aperture 48, the side-load aperture 48 forming a part of the first aperture 42, and the second aperture 46 of the receiver 40. See FIG. 9B. In this alternative embodiment, the second receiver aperture 46 has enough circumferential surface to capture the trunk 64 and branches 65 of the tie mount 60 within it. Additionally, and although the presence of the side-load aperture 48 eliminates one of the flats 44 of the first aperture 42, the second flat 44 can be used with one of the flats 69 of the tie mount 60 to properly align the mount 60 within the side-load aperture 48 and the tie mount receiver 40 of the upper jaw 20. In all other respects, the construction and functionality of the upper jaw 20 having the side-load aperture 48 is the same as the upper jaw 20 without the side-load aperture 48, as described above.

Accordingly, it will be seen that there has been provided a new and useful jaw assembly for use with a tool of the type for binding objects by means of a tie strap, the tool having a tool body and a clamp formed by opposing jaws; which jaw assembly is mounted in a movable manner on the tool body, and is provided with a tie strap guide; which jaw assembly makes it possible for the jaws to be closed such that, in a closed state, their distal ends are engaged and clamped about the objects to be bound and which provides a continuum of the tie strap guide along the jaws and about the objects to be bound; and which jaw assembly provides a tie mount receiver for placing a tie mount within at least one of the jaws, a portion of the tie mount also forming part of the tie strap guide continuum.

What is claimed is:

1. A tool for bundling elongated items by means of a tie strap, the tie strap having a tail and a tail-receiving head, the tool comprising:

a tool body;

a pair of cooperating jaws, the jaws being mounted in a movable manner on the tool body, and each jaw providing a guide means for the tie tail and at least one jaw including means for receiving a tie mount within the jaw, the tie mount including means for receiving a portion of the tie strap tail through it;

means for actuating the jaws from an open position to a closed position; and means for introducing the tail of the tie strap to the jaws;

wherein a tie strap tail introduced to the jaws is guided along each jaw and through the tail receiving means of the tie mount to bundle the elongated items.

2. The tool of claim 1 wherein actuation of the jaws to the closed position allows the jaws to encircle and clamp down upon the bundle of elongated items.

3. The tool of claim 2 wherein each jaw includes an inner edge and the jaw guide means includes a guide groove defined within the inner edge of the jaw.

4. The tool of claim 3 wherein the guide grooves of the jaws forms a curvilinear guide groove continuum about the inner edges of the jaws when the jaws are in the closed position.

5. The tool of claim 4 wherein the tie mount receiving means of the at least one jaw comprises a tie mount receiver defined within the inner edge of the at least one jaw.

6. The tool of claim 5 wherein the tie mount receiver includes means for seating a tie mount placed within the tie mount receiver, the tie mount including a tie mount aperture, which aperture forms part of the curvilinear guide groove continuum about the inner edges of the jaws when the jaws are in the closed position.

7. The tool of claim 6 wherein the tie mount aperture forms a portion of a side-load aperture that is defined within the at least one jaw.

8. A tool for bundling elongated items by means of a tie strap, the tie strap having a tail and a tail-receiving head, the tool comprising:

a tool body;

an upper jaw and a lower jaw, the jaws being mounted in a movable manner on the tool body;

means for actuating the jaws from an open position to a closed position;

wherein the upper jaw comprises a portion that is proximal to the tool body and a portion that is distal to the tool body, and a downwardly and inwardly facing jaw edge wherein the lower jaw comprises a portion that is proximal to the tool body and a portion that is distal to the tool body, and an upwardly and inwardly facing jaw edge that opposes the edge of the upper jaw; and means for introducing the tail of the tie strap to the jaws;

wherein each jaw comprises a guide means for the tie tail and at least one jaw comprises means for receiving a tie mount within the jaw, the tie mount comprising means for receiving a portion of the tie strap tail through it when the tie mount is received with the jaw such that a tie strap tail introduced to the jaws is guided along each jaw and through the tail receiving means of the tie mount to bundle the elongated items.

9. The tool of claim 8 wherein the tool body comprises an inner tie strap tail guide which is adjoined by the tie strap tail guide means that is configured within the jaws to form a tie strap guide continuum.

10. The tool of claim 9 wherein the inner guide of the tool is substantially continuous and curvilinear with a guide groove that is defined within the upper and inward-facing edge of the lower jaw and is also substantially continuous and curvilinear with guide grooves that are defined within the downward and inward-facing edge of the upper jaw.

11. The tool of claim 10 wherein the guide groove of the lower jaw comprises a guide groove extending from the proximal portion of the lower jaw to the distal portion of the lower jaw, and wherein the guide grooves of the upper jaw comprise a guide groove within the distal portion of the upper jaw and a guide groove within the proximal portion of the upper jaw.

12. The tool of claim 11 wherein the guide groove within the proximal portion of the upper jaw is tapered inwardly deeper and away from the upper jaw edge at its distal-most point.

13. The tool of claim 12 wherein the means for receiving a tie mount within at least one jaw comprises an upper jaw receiver that is disposed between the guide groove of the distal portion of the upper jaw and the guide groove of the proximal portion of the upper jaw.

14. The tool of claim 13 wherein the upper jaw receiver is configured with an inwardly facing first aperture, the first aperture comprising a rim that substantially surrounds a shoulder and further comprises a second aperture that extends outwardly from the shoulder of the first aperture.

15. The tool of claim 14 wherein the jaw receiver further comprises alignment means for orientating the tie mount within the jaw receiver and wherein the tie mount comprises an aperture, which aperture forms part of the curvilinear guide groove continuum about the inner edges of the jaws when the jaws are in the closed position.

16. The tool of claim 15 wherein the tie mount that is receivable within the jaw receiver comprises a head portion and a trunk portion, the head portion comprising an aperture defined within it, which aperture is configured to receive and retain a portion of a tie strap tail within it and, disposed below the head is a circumferential umbrella and a trunk which comprises a plurality of transversely disposed and outwardly-extending branches, such branches being biased upwardly of the trunk towards the head so as to resist removal of the tie mount from a surface.

17. The tool of claim 16 wherein the tie mount alignment means comprises opposing flats defined within the circumferential shoulder of the tie mount and opposing flats defined within the first aperture of the upper jaw receiver, the opposing flats of the tie umbrella being functionally adapted to cooperate with the flats of the first aperture of the jaw receiver to align the tie mount within the receiver.

18. The tool of claim 17 wherein the upper jaw receiver forms a portion of a side-load aperture that is defined within the upper jaw.

* * * * *